United States Patent [19]

DelVecchio et al.

[11] Patent Number: 4,595,843

[45] Date of Patent: Jun. 17, 1986

[54] LOW CORE LOSS ROTATING FLUX TRANSFORMER

[75] Inventors: Robert M. DelVecchio, Sunnyvale, Calif.; Robert F. Krause, Murrysville, Pa.

[73] Assignee: Westinghouse Electric Corp., Pittsburgh, Pa.

[21] Appl. No.: 607,852

[22] Filed: May 7, 1984

[51] Int. Cl.[4] ..... H01H 85/02

[52] U.S. Cl. ..... 307/83; 336/183; 336/184; 336/195; 336/229; 307/416

[58] Field of Search ..... 336/183, 184, 195, 229; 323/215; 307/83, 416

[56] References Cited

U.S. PATENT DOCUMENTS

| | | | |
|---|---|---|---|
| 2,907,894 | 10/1959 | Bonn | 307/416 |
| 3,004,171 | 10/1961 | Lipkin | 307/416 |
| 3,266,000 | 8/1966 | Markarian | 336/229 |
| 3,351,860 | 11/1967 | Wolff | 336/229 X |

FOREIGN PATENT DOCUMENTS

| | | | |
|---|---|---|---|
| 657142 | 9/1951 | United Kingdom | 336/229 |
| 987694 | 1/1983 | U.S.S.R. | 336/229 |

*Primary Examiner*—A. D. Pellinen
*Assistant Examiner*—Derek S. Jennings
*Attorney, Agent, or Firm*—D. R. Lackey

[57] ABSTRACT

A transformer utilizing a rotating flux for saturating the entire core. The transformer uses a core configured such that a vector sum of the induction produced by two windings in the core rotates through 360°. This is accomplished by arranging the component induction vectors to be perpendicular and the source voltages associated with each of the component induction vectors to be 90° out of phase. If the inductions are of equal magnitude and the vector sum is sufficient to saturate the core, rotation of the vector sum saturates the entire core and the transformer experiences a very low or nearly negligible hysteresis losses. Various topological configurations for the core, including a toroid, are described. The transformer windings can be arranged for single, two-phase, three-phase, or multi-phase operation.

24 Claims, 10 Drawing Figures

LOW CORE LOSS ROTATING FLUX TRANSFORMER

BACKGROUND OF THE INVENTION

1. Field of the Invention

This invention relates generally to low core loss flux transformers, and more specifically, to such transformers that have a rotating flux vector for saturating the core to reduce hysteresis losses.

2. Description of the Prior Art

It is well known that transformer cores experience two types of losses: hysteresis losses and eddy current losses. Hysteresis losses represent the energy expended in reversing the magnetic moments of the core when the core is subjected to an ac field. It is well known that the hysteresis losses can be reduced to zero by subjecting the magnetic core to a rotating magnetic induction at the saturation level. Eddy currents are established in the magnetic core by the changing magnetic field, and energy is lost as heat by the circulation of eddy currents in the core. Some core materials wth high resistivities, such as ferrites and amorphous metals, have naturally low eddy current losses. Hence, a rotating saturated induction vector generates very low total losses in these materials. Further, amorphous metals have an anomalously high eddy current loss under unidirectional ac flux conditions associated with the size of their magnetic domains. By operating at saturation with a rotating flux, these domains and their associated losses are eliminated.

SUMMARY OF THE INVENTION

A transformer for providing low hysteresis losses is disclosed. The low hysteresis losses are due to the use of a rotating flux, rather than unidirectional oscillating flux. A torus with appropriately positioned windings is used in the two-phase configuration. The toroidal core operates at or near saturation to produce low rotational hysteresis losses. In addition, if the resistivity of the core material is high, the eddy current losses are also low, resulting in a low core loss transformer. Ferrites and amorphous metal ribbons are useful core materials for this type of transformer, the former because of its high resistivity, and the latter because of its reasonably high resistivity and the absence of domain structure at saturation. The ideal core material should also saturate easily to keep the exciting current small. The core material should also have nearly isotropic magnetic properties, at least in the plane in which the induction vector rotates. If there are magnetic anisotropies, different exciting currents may be required in the two phases to saturate the core in all flux directions. Various core configurations and winding arrangements to provide a saturated core for single-phase, two-phase, and three-phase transformers are disclosed. It should be noted that all the transformer embodiments disclosed herein could operate as transformers at any induction below saturation, but the advantages of good material utilization and low losses would not be fully realized. In addition, rotating flux transformers having any number of phases may be designed using the ideas disclosed herein.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF THE PREFERRED EMBODIMENTS

Figure 1:
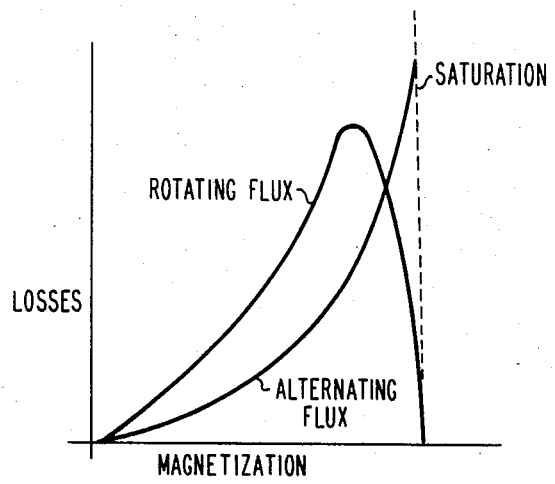
FIG. 1 is a graph showing core losses for a rotating flux and an alternating flux transformer.

Turning to FIG. 1, there is shown a graph of dc or very low frequency core losses as a function of magnetization. Note that for a core with an alternating flux, as in the typical transformer, losses increase as a function of increasing magnetization and at saturation the losses are substantial. A transformer core using the rotating flux principle also has increasing losses with increasing magnetization up to a certain point, but has negligible losses at the saturation magnetization. The present invention applies this principle to the development of a low-loss transformer core.

Figure 2:
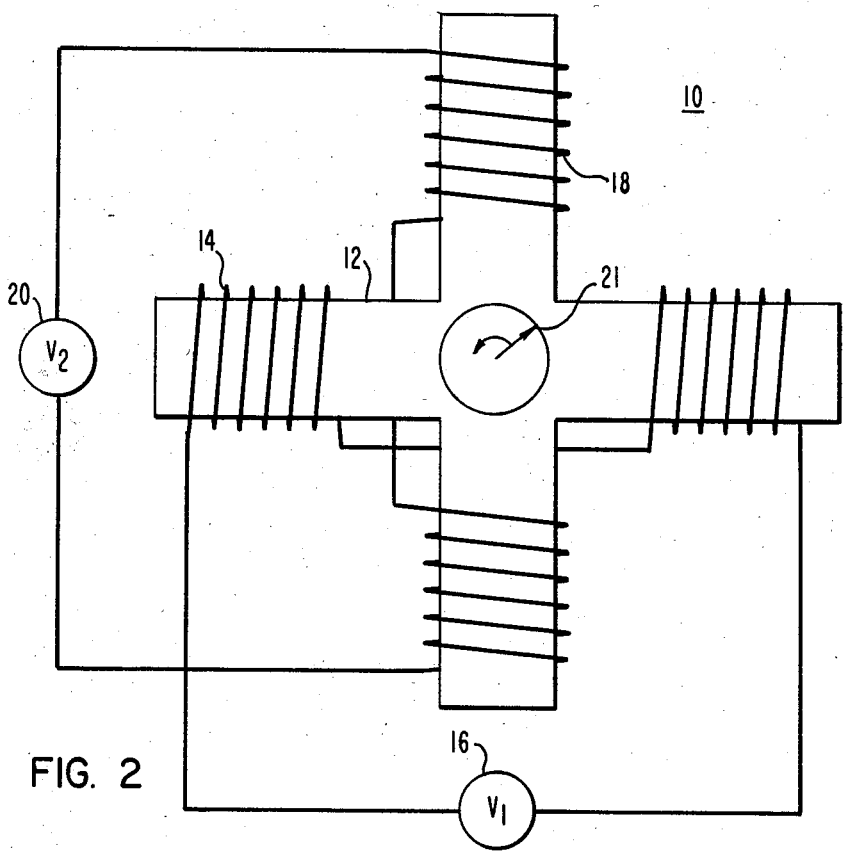
FIG. 2 illustrates a first means of achieving a rotating induction vector in a limited volume of magnetic material.

In FIG. 2, there is shown a device 10 including a core 12. The core 12 is in the shape of a cross, with flux return yokes not shown in FIG. 2. The device 10 includes a coil 14 wound around first and second arms of the core 12 and connected to a sinusoidal voltage source 16. The device 10 also includes a coil 18 wound around third and fourth arms of the coil 12 and connected to a sinusoidal voltage source 20. The induction in the center of the core 12 is the vector sum of the inductions produced by the coils 14 and 18. If the sinusoidal voltage sources 16 and 20 are 90 electrical degrees out of phase and of equal peak magnitude and the coils 14 and 18 have equal numbers of turns, the resultant induction vector, reference numeral 21, in the center of the core 12 traces out a circle as it rotates with time. Of course, the device 10 produces a rotating flux with attendant low core losses only in the central portion of the core 12. A practical transformer utilizing this principle is increasingly more effective as more of the core is subjected to the rotating flux.

Figure 3A:
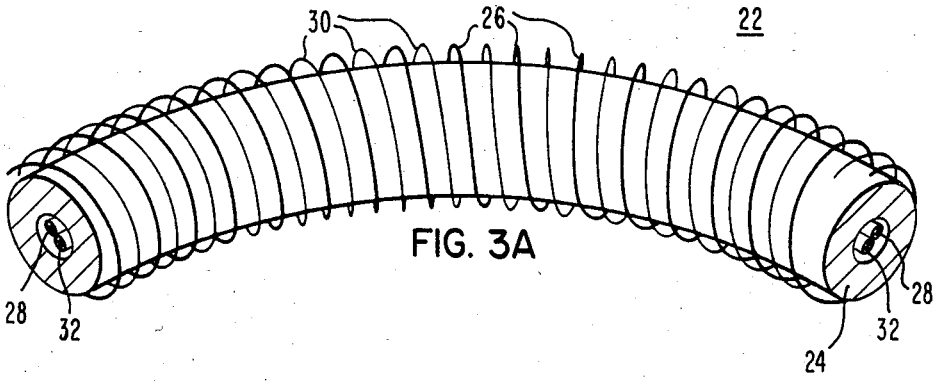
FIG. 3A illustrates a first embodiment of a transformer constructed according to the teachings of the present invention.
Figure 3B:
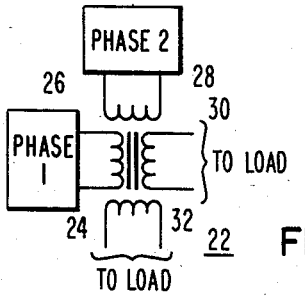
FIG. 3B is a schematic representation of the transformer shown in FIG. 3A.

A cross-sectional view of a transformer 22, connected for two-phase operation, is shown in FIG. 3A. FIG. 3B is a schematic diagram of transformer 22. The transformer 22 includes a toroidal core 24, toroidal primary and secondary coils 26 and 30, repsectively, and poloidal primary and secondary coils 28 and 32, respectively.

The toroidal primary coil 26 is responsive to a phase 1 sinusoidal voltage (shown in FIG. 3B) and the poloidal primary coil 28 responds to a phase 2 sinusoidal voltage (shown in FIG. 3B). The toroidal and poloidal secondary coils 30 and 32 deliver currents to loads shown in FIG. 3B.

Figure 4:
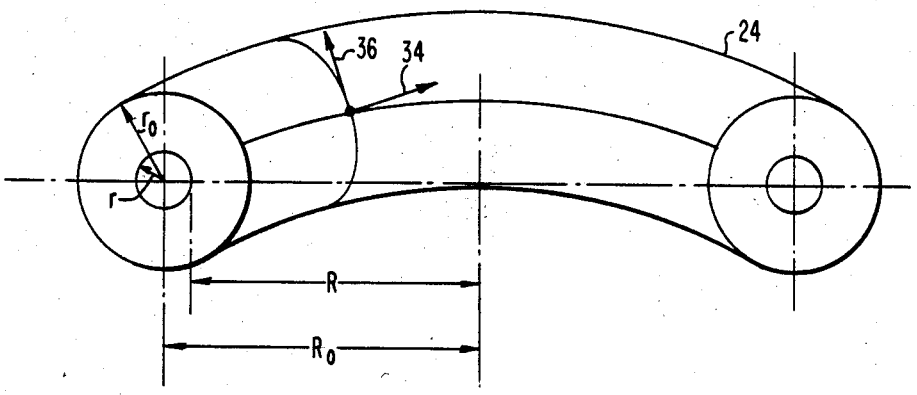
FIG. 4 illustrates the induction vectors associated with the transformer of FIG. 3.

The toroidal primary coil 26 generates a sinusoidal magnetic field and induction vector pointing along the large circle of the toroidal core 24. This induction vector is shown generally as induction vector 34 in FIG. 4, which includes only the toroidal core 24 for simplicity. The poloidal primary coil 28 creates a sinusoidal magnetic field and induction vector pointing approximately along the small circles of the toroidal core 24. The induction vector created by the poloidal primary coil 28 is designated as induction vector 36 in FIG. 4. For the case where the small circles of the toroidal core 24 are much smaller than the large circles thereof, the field lines around the poloidal primary coil 28 are circular. As the size of the small circles increases relative to the large circles, the field lines deviate somewhat from a circular shape due to the effect of the curvature of the poloidal primary coil 28. As shown in FIG. 4, the small circles and large circles of th toroidal core 24 are perpendicular, and therefore, the component induction vectors associated with the toroidal and poloidal primary coils 26 and 28 are perpendicular. If the phase 1 and 2 sinusoidal voltages associated with the toroidal and poloidal primary coils 26 and 28 are 90 electrical degrees out of phase, the resultant induction vector (i.e. the vector sum of component induction vectors) is the toroidal core 24 rotates through 360°. If the individual sinusoidal induction components of the resultant vector are of equal peak magnitude, the tip of the rotating induction vector traces out a circle. If the magnitude of the resultant induction vector is at the saturation level for the toroidal core 24, then the entire toroidal core 24 saturates causing the magnetic domain walls to disappear, eliminating the hysteresis and anomalous eddy current losses.

It should be noted that in another embodiment of the present invention a transformer will operate satisfactorily if the induction vector components are only approximately 90 electrical degrees apart in phase. This situation could occur if the induction vectors 34 and 36 (see FIG. 4) are not strictly perpendicular in space. Note that the resultant induction vector also traces out an ellipse if the induction vectors 34 and 36 have unequal magnitudes, or are not 90 electrical degrees apart (although spatially perpendicular).

Although the induction vectors 34 and 36 should be of equal magnitudes and 90° electrical degrees apart for ideal operation, this does not necessarily imply that the phase 1 and 2 sinusoidal voltages (and the load voltages) should be of equal magnitudes and 90 electrical degrees apart. The magnitudes of the pahse 1 and 2 sinusoidal voltages are determined not only by the magnitudes of the induction vectors 34 and 36, but also by the number of turns of the toroidal primary and poloidal primary coils 26 and 28. In addition, the 90° phase relation for the transformer 22 applies to an ideal transformer. With resistive and inductive voltage drops in the toroidal primary and poloidal primary coils 26 and 28, the phase 1 and 2 sinusoidal voltages may not be 90 electrical degrees apart. A similar situation arises with three- or multi-phase transformer embodiments.

Note that the resultant induction vector rotates through 360° repetitively, once for each cycle of input voltage, e.g. 60 times per second for a 60 Hz input voltage. Any operating frequency will provide low core losses provided the eddy current losses do not become too great.

Continuing with FIG. 3A, the magnetic field associated with the toroidal and poloidal primary coils 26 and 28 can be calculated from the following equations, in MKS units.

$$H_T = \frac{N_T I_T}{2\pi R}$$

$$H_P = \frac{N_P I_P}{2\pi r}$$

where the subscripts T and P refer respectively to the toroidal primary coil 26 and the poloidal primary coil 28, $N_T$ is the number of turns in the toroidal primary coil 26, $N_P$ is the number of turns in the poloidal primary coil 28, $I_T$ is the current in the toroidal primary coil 26, $I_P$ is the current in the poloidal primary coil 28, and R and r are radii defined in FIG. 4. The formula for $H_P$ strictly applies to the case of an infinitely long strand of wire, but is approximately applicable in this situation.

As an example of use of these equations, assume a toroidal core 24 with $R_o=0.1$ m and $r_o=0.05$ m and assume that the two field components are $H_T=H_P=1$ Oe=80 A-t/m to saturate the core material. The resulting number of ampere turns are:

$$H_T = 80 \text{ A-t/m} = \frac{N_T I_T}{2\pi(.1\text{m})}$$

$$N_T I_T = 50 \text{ ampere-turns}$$

$$H_P = 80 \text{ A-t/m} = \frac{N_P I_P}{2\pi(.05\text{m})}$$

$$N_P I_P = 25 \text{ ampere-turns}$$

The above results will change somewhat depending upon the exact position in the toroidal core 24, and it is possible to calculate the number of ampere turns required to saturate every point in the toroidal core 24. The point $R=R_o+r_o=0.15$ m is the hardest to saturate with the toroidal primary coil 26 and requires:

$$N_T I_T = 75 \text{ ampere-turns}$$

The point $r=r_o$ is the hardest to saturate with the poloidal primary coil 28 so $N_P I_P$ is 25 ampere-turns. With these values, the magnetic field within the toroidal core 24 varies from point to point but every point therein is at saturation induction and the induction vectors rotate circularly.

In this example, if the magnetizing current is chosen to be one ampere in each coil, then the number of turns required are:

$$N_T = 75 \text{ turns}$$

$$N_P = 25 \text{ turns}$$

The output voltages from the toroidal and poloidal secondary coils 30 and 32 are 90 electrical degrees out of phase. As will be discussed hereinafter, it is also possible to design similar transformers with rotating induction vectors for single phase and three phase operation.

Figure 5:
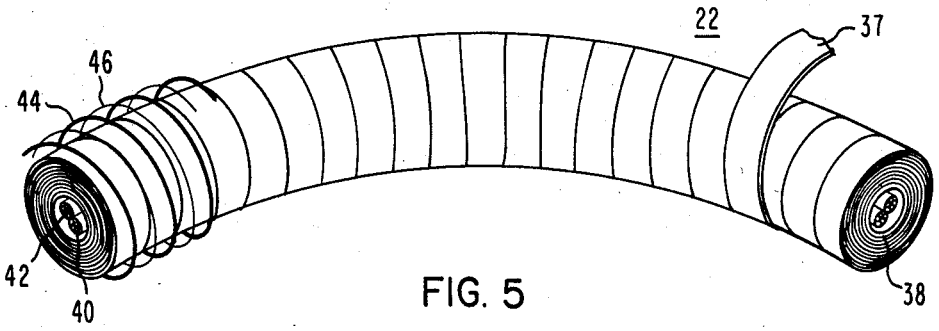
FIG. 5 illustrates a second embodiment of a transformer constructed according to the teachings of the present invention.

In one embodiment of the present invention, it would be desirable for the material from which the toroidal core 24 is constructed to have isotropic magnetic properties and saturate very easily. In the case of ferrites, the core could be pressed into the toroidal shape, perhaps around the poloidal primary and secondary coils 28 and 32. An embodiment of the transformer 22 using amorphous metals is illustrated in FIG. 5. Here again, the toroidal core 24 is shown in cross section. The amorphous ribbon 37 is wrapped around a toroidal mandrel 38, containing the poloidal primary and secondary coils 40 and 42. A toroidal primary coil 44 and a toroidal secondary coil 46 are also shown in FIG. 5. The wraps of the amorphous ribbon 37 generally parallel the small circles of the torus and can contain breaks. The two induction components from the primary toroidal and poloidal coils 40 and 44 are confined to the plane of the laminations. The in-plane magnetic properties are nearly isotropic for this amorphous metal when annealed in the absence of a magnetic field or in the presence of a rotating magnetic field.

Numerous other embodiments of the present invention are possible using various core shapes. Any shape which is topologically equivalent to a torus can be used. The cross-sectional shape of the toroidal core 24 need not be circular; the toroidal core 24 can have an elliptical or rectangular cross-section. The hole or window would have the same shape since otherwise the poloidal flux would encounter different areas as it travels around the bore. The present invention can also be used with anisotropic materials where unequal magnetizing forces are used to saturate the core in two directions. The principal requirement for use with anisotropic materials is a net magnetizing force sufficient to saturate the core material in all directions through which the flux rotates.

Figure 6:
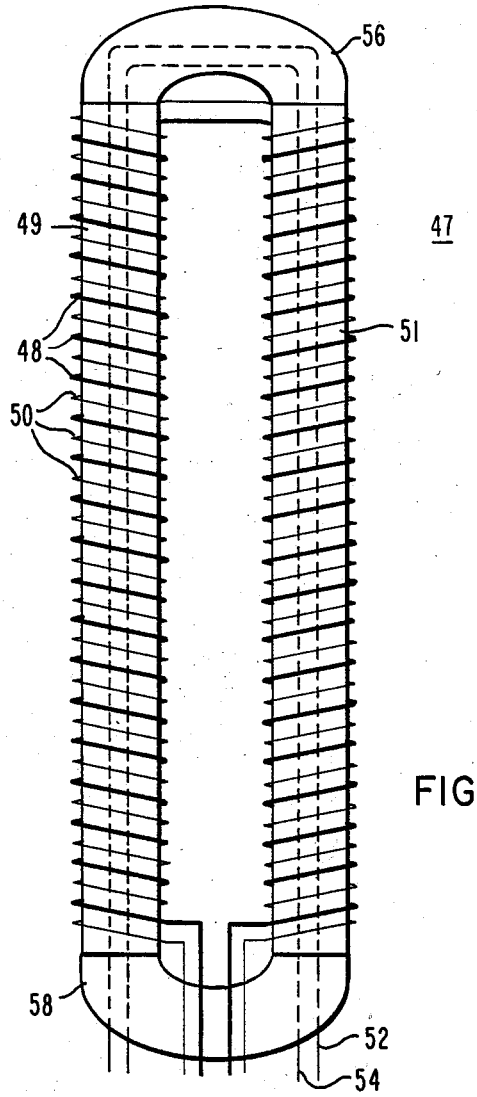
FIG. 6 illustrates a third embodiment of a transformer constructed according to the teachings of the present invention.

Another embodiment of a transformer using the principles of the present invention is illustrated in FIG. 6. The transformer 47 includes cylindrical cores 49 and 51 placed side by side. The longer the cylindrical cores 49 and 51, the less important are the at the ends of the cores effects. Also, the end effects may be reduced by completing the flux path with semicircular end caps 56 and 58 constructed of core material. The end caps 56 and 58 could also be cylindrical and joined to the cylindrical cores 49 and 51 by means of miter joints. In essence then, the transformer 47 is a toroid with elongated sides and may be easier to construct than the circular toroid illustrated in FIG. 3. In general, the cylindrical cores 49 and 51 and the end caps 56 and 58 need not have circular cross-sections.

A solenoidal primary coil 48 and a solenoidal secondary coil 50 are wound around the cores 49 and 51. An interior primary coil 52 and an interior secondary coil 54 are located within a hole in the cores 49 and 51. The interior primary and secondary coils 52 and 54 could also pass through the central holes in the end caps 56 and 58. Note that the shape of the transformer 47 is topologically equivalent to the transformer 22 in FIG. 3, and the principles of the present invention can be used with other shapes topologically equivalent to a toroid. Although only two phases are shown in FIG. 6, the transformer 47, in other embodiments, can be operated as a single phase or three phase transformer by techniques to be discussed hereinbelow.

FIG. 3A illustrates a two-phase embodiment for the transformer 22, but it is also possible to use the transformer 22 as a single-phase transformer. In one such single-phase embodiment, the transformer 22 would have toroidal primary and secondary coils 26 and 30 as shown in FIG. 3A, but only a primary poloidal coil 28; there would be no poloidal secondary coil 32. The poloidal primary coil 28 draws only exciting current. The source voltage and the exciting voltage must be 90° out of phase. A 90° phase shift for the exciting voltage can be obtained by connection to the main supply voltage or to another toroidal coil through resistive and capacitive elements. Since the poloidal primary coil would carry only exciting current, it can be constructed of a small wire size. In another single-phase configuration, the transformer 22 could have poloidal primary and secondary coils 28 and 32, but only a primary toroidal coil 26. That is, the toroidal secondary coil 30 shown in FIG. 3A would be absent.

The two-phase configuration for the transformer 22 provides a more efficient utilization of the core material. Because the flux is rotated and always at saturation, it can be used more effectively when producing voltage transformations in two phases. The core utilization in the two-phase embodiment is also higher than the core utilization in a single phase unidirectional flux transformer by a factor of almost 2.

Figure 7A:
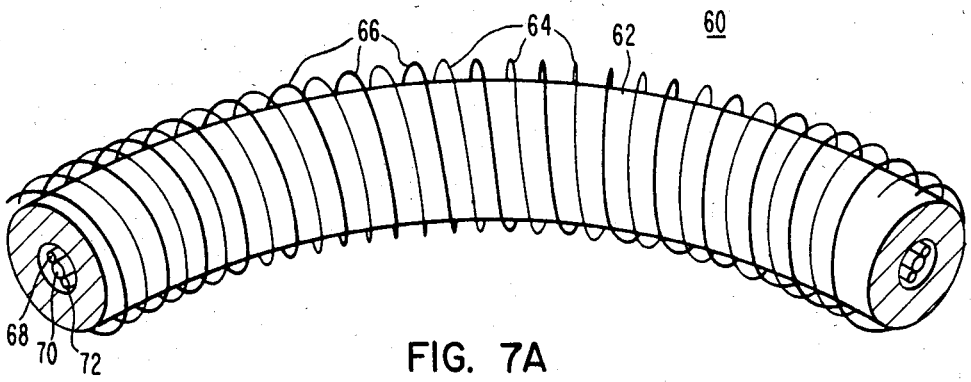
FIG. 7A illustrates a three-phase transformer constructed according to the teachings of the present invention.
Figure 7B:
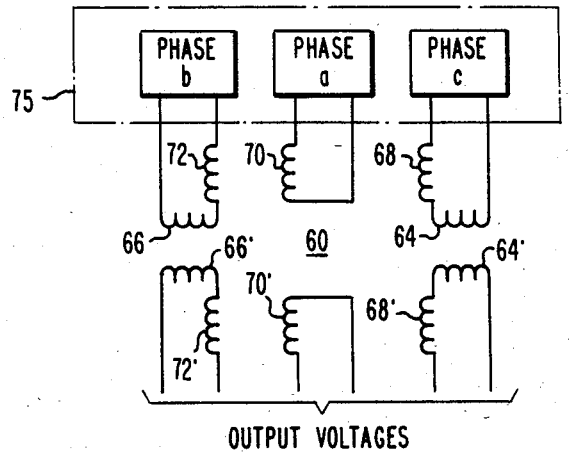
FIG. 7B is a schematic representation of the three-phase transformer shown in FIG. 7A.
Figure 7C:
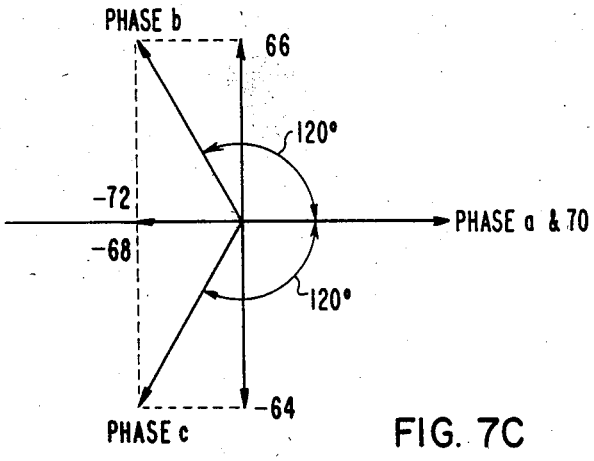
FIG. 7C is a graph showing the vector or phasor relationship for the coils of the transformer of FIGS. 7A and 7B.

Turning to FIGS. 7A and 7B, there is shown a three-phase transformer 60 employing the principle of the present invention and suitable for use on three-phase systems. For simplicity, only one set of coils, representing the primary coils, are illustrated in FIG. 7A. The secondary coils are given the same reference numbers as the associated primary coils, with the addition of a prime mark. The secondary coils would have the same configuration as the primary coils, as shown schematically in FIG. 7B. The three-phase transformer 60 includes a core 62 and toroidal windings 64 and 66 wound around the core 62. The core 62 has a hole therethrough in which poloidal windings 68, 70 and 72 are located. FIG. 7C illustrates the vector and phasor relationship of the toroidal coils 64 and 66 and the poloidal coils 68, 70 and 72, with respect to the three-phase power supply voltages 75. The phase relationships are given below:

Phase a=coil 70 voltage

Phase b=coil 66−coil 72 voltages

Phase c=−coil 64−coil 68 voltages

The minus signs in the above equations are achieved by reversing the coil terminations before connection to the supply voltages. The signs for the poloidal coils 68 and 72 are relative to the poloidal coil 70, and the sign for the toroidal coil 64 is relative to the toroidal coil 66, i.e., without reversing the coil terminations, the poloidal coils 68, 70, and 72 would be in phase and the toroidal coils 64 and 66 would be in phase.

FIGS. 7A and 7B merely illustrate one way of utilizing a rotating flux transformer in a three-phase configuration. Others would include interchanging the roles of the inner and outer coils. Note that the toroidal coils 64 and 66 and the poloidal coils 68, 70, and 72 do not all have the same number of turns. The number of turns for each coil is determined by the angle desired between the various phases, 120° in the three-phase case. More than three-phases could be accommodated by using angles smaller than 120° and adjusting the number of turns taken from the toroidal coils 64 and 66 and the poloidal coils 68, 70, and 72 (and their secondary counterparts.)

What is claimed is:

1. A transformer, comprising:

first and second alternating source voltages having the same frequency but phase displaced by about ninety electrical degrees;

a magnetic core in the form of a closed magnetic loop having an outer surface disposed about a longitudinal axis, and an axially extending opening;

a toroidal primary winding responsive to the first source voltage and disposed about the outer surface of said magnetic core for establishing a first magnetic flux therein;

a poloidal primary winding responsive to the second source voltage and disposed through the axially extending opening of said magnetic core for establishing a second magnetic flux therein;

a first secondary winding disposed in inductive relation with said magnetic core and a selected one of said primary windings for providing a first secondary voltage;

wherein the magnitudes of said first and second source voltages are selected to substantially saturate the entire magnetic core, with the specified phase relationship, configuration of said magnetic core, and placement of said primary windings causing the vector sum of the sinusoidal induction vector produced by said primary windings to rotate through approximately 360° during one cycle of the first and second alternating source voltage, to substantially reduce hysteresis losses in said magnetic core.

2. The transformer of claim 1 including a second secondary winding disposed in inductive relation with the magnetic core and with the unselected primary winding for providing a second secondary voltage.

3. The transformer of claim 1 wherein the magnetic core is a toroidal core and the axially extending opening is a bore therethrough concentric with the axis of said toroidal core.

4. The transformer of claim 3 wherein the magnetic core has a circular cross-section, and the bore has a circular shape.

5. The transformer of claim 3 wherein the outer surface of the magnetic core and the bore have similar cross-sectional configurations.

6. The transformer of claim 3 wherein the first secondary winding is a poloidal winding positioned within the bore.

7. The transformer of claim 6 including a second secondary winding wound around the toroidal core for providing a second secondary voltage.

8. The transformer of claim 3 wherein the first secondary winding is a toroidal winding wound around the toroidal core.

9. The transformer of claim 8 including a second secondary winding positioned within the bore for providing a second secondary voltage.

10. The transformer of claim 1 wherein the magnetic core includes two parallel members separated by a predetermined distance, and wherein each member has a longitudinal bore therethrough, and wherein the winding toroidal primary includes a first solenoidal winding wound around both parallel members, and wherein the poloidal primary winding includes a first internal winding positioned within said longitudinal bore of each parallel member.

11. The transformer of claim 10 wherein the magnetic core has a circular cross section, and the longitudinal bore has a circular shape.

12. The transformer of claim 10 wherein the outer surfaces of the parallel members of the magnetic core and their longitudinal bores have similar cross-sectional configurations.

13. The transformer of claim 10 including a first arcuate end cap in registry with a first end of the parallel members and a second arcuate end cap in registry with a second end of the parallel members, and wherein said first and second arcuate end caps each have a bore therethrough in registry with the longitudinal bores of the two parallel members, and wherein the poloidal primary winding is positioned within said bores of said first and second arcuate end caps.

14. The transformer of claim 10 including a first end cap in registry with a first end of the parallel members and a second end cap in registry with a second end of the parallel members, wherein said first and second end caps are parallel, and wherein said first and second end caps each have a bore therethrough in registry with the longitudinal bore of the two parallel members, and wherein the poloidal primary winding is positioned within said bores of said first and second end caps.

15. The transformer of claim 10 wherein the first secondary winding is a solenoidal winding disposed about each of the parallel members.

16. The transformer of claim 15 including a second secondary winding positioned within the longitudinal bore of each parallel member for providing a second secondary voltage.

17. The transformer of claim 10 wherein the first secondary winding is a poloidal winding positioned within the longitudinal bore of each parallel member.

18. The transformer of claim 17 including a second secondary winding disposed about each of the parallel members for providing a second secondary voltage.

19. The transformer of claim 1 wherein the magnetic core is constructed of a magnetically isotropic material.

20. The transformer of claim 1 wherein the magnetic core is constructed of a laminated material and wherein said laminated material is magnetically isotropic in the plane of the laminations.

21. The transformer of claim 1 wherein the magnetic core is constructed of a magnetically anisotropic material.

22. The transformer of claim 1 wherein the magnitudes and phase relationship of the first and second source voltages are such that the sinusoidal induction vector produced by the first electrical winding means and the sinusoidal inductor vector produced by the second electrical winding means have equal peak magnitudes, to cause the rotating induction vector to trace a circular configuration.

23. The transformer of claim 1 wherein the magnetic core is constructed of an amorphous material.

24. A transformer responsive to first, second, and third alternating primary source voltages of equal magnitudes and 120° out of phase, for producing first, second, and third secondary voltages of equal magnitudes and 120° out of phase, said transformer comprising:

a toroidal magnetic core defining an opening concentric with the longitudinal axis of said toroidal magnetic core;

first and second primary toroidal windings disposed about said toroidal magnetic core;

first and second secondary toroidal windings disposed about said toroidal magnetic core;

first, second, and third primary poloidal windings disposed within the opening defined by said magnetic core;

and first, second, and third secondary poloidal windings disposed within the opening defined by said magnetic core;

the first primary source voltage being connected across said first primary poloidal winding, with the first secondary poloidal winding providing the first secondary voltage;

the second primary source voltage being connected across a series combination of said first primary toroidal winding and said second primary poloidal winding, with the second secondary voltage being provided by a series combination of said first secondary toroidal winding and said second secondary poloidal winding;

the third primary source voltage being connected across a series combination of said second primary toroidal winding and said third primary poloidal winding, with the third secondary voltage being provided by a series combination of said second secondary toroidal winding and said third secondary poloidal winding;

wherein the vector sum of the sinusoidal induction vectors produced by said first and second primary toroidal windings and said first, second and third primary poloidal windings substantially saturates the magnetic core and rotates through approximately 360 degrees during one cycle of the first, second and third alternating primary source voltages.

* * * * *